United States Patent [19]

Schurman

[11] 4,069,915

[45] Jan. 24, 1978

[54] TOOL CASE

[75] Inventor: Peter T. Schurman, Woodbridge, Conn.

[73] Assignee: The Plastic Forming Company, Inc., Woodbridge, Conn.

[21] Appl. No.: 728,274

[22] Filed: Sept. 30, 1976

[51] Int. Cl.[2] ..... B65D 85/20; B65D 85/54

[52] U.S. Cl. ..... 206/305; 206/349; 206/477; 206/564

[58] Field of Search ..... 206/45.14, 45.19, 305, 206/349, 362.2, 368, 372, 376, 378, 477, 480, 486, 525, 527, 806, 564

[56] References Cited

U.S. PATENT DOCUMENTS

| | | | |
|---|---|---|---|
| 2,696,294 | 12/1954 | Tarnay | 206/372 |
| 2,779,560 | 1/1957 | Springer | 206/362.2 X |
| 3,130,834 | 4/1964 | Korzaan | 206/349 |
| 3,735,860 | 5/1973 | Nissen et al. | 206/349 |

*Primary Examiner*—Steven E. Lipman
*Attorney, Agent, or Firm*—St. Onge, Mayers, Steward & Reens

[57] ABSTRACT

A case is disclosed for a tool that includes an elongated shaft and a fitting attached to and extending perpendicularly from the shaft at a location spaced from a free shaft end. The case comprises a body which is formed with a tool shaft accepting recess, a first socket extending axially from the recess for receiving the free end of the shaft and a second socket extending perpendicularly to the recess for receiving the tool fitting. Axial movement of the tool is prevented when the free end of the shaft and the fitting are respectively received in the first and second sockets. Moreover, the tool can only be removed from the case by first disengaging the fitting from the second socket and then disengaging the free end of the shaft from the first socket.

7 Claims, 6 Drawing Figures

TOOL CASE

BACKGROUND OF THE INVENTION

The present invention relates to a case for storing and carrying as well as for displaying a tool which has an elongated shaft and a fitting attached to and extending perpendicularly from the shaft. This case is particularly well adapted to receive a tool such as a beam torque wrench which includes an elongated shaft having a wrench socket accepting fitting mounted perpendicularly thereto at one end, a handle at the opposite free end, and a torque indicating beam cantilevered from the fitting extending parallel to the shaft. Of course, the case can be used for other tools of similar basic configuration.

Certain tools which have delicate components are desirably stored and carried in a manner which provides a measure of protection for them. For example, the torque indicating beam of certain torque wrenches should be protected so that it is not bent or otherwise damaged. If damage does occur, it can make the wrench inaccurate or even inoperative.

Tools such as the torque wrench described above are often sold without a case. Or they may be sold in a box or carton and be surrounded by a disposable packing material like Styrofoam. In either case, protection for the tool is not provided once it is brought to a workshop and any packing material is discarded.

Cases are available for carrying and storing such tools, but these frequently don't adequately protect delicate tool components, particularly if the tool is not precisely cradled in them. Those cases which do provide a measure of protection for a tool by having a full base and a full lid are often expensive. Moreover, such cases ordinarily do not provide convenient display of the tool without opening the lid.

SUMMARY OF THE INVENTION

In a preferred embodiment, to be described below in detail, the case of the present invention is constructed to store and carry as well as to display a tool, such as a beam torque wrench, which has delicate components. The case may be used with equal advantage in a store where the tool is sold or in the workshop where the tool is used and, therefore, eliminates the need for a separate carton in which the tool is sold and a case in which the tool may later be carried and stored. Moreover, though the case protects delicate components of the tool, the tool is almost completely visible for sales purposes.

In its preferred embodiment, the case is designed to hold a beam torque wrench, such as that disclosed in U.S. Pat. No. 3,726,135 (Vuceta), which has an elongated shaft and a work engaging fitting attached to and extending perpendicularly from the shaft at a location spaced from a free shaft end. A torque indicating beam is attached to the fitting and extends parallel to the shaft to be deflected when a torque-generating force is applied to the wrench shaft. A handle is pivotably fixed to the free shaft end and a torque indicating gauge is mounted on the shaft in operative relation to the beam.

The case of the present invention includes a body formed with an elongated tool shaft accepting recess. A first socket extends axially from this recess and is shaped to receive the free end of the shaft on which the handle is mounted. A second socket extends perpendicularly from the recess and is shaped to receive the work engaging tool fitting. Accordingly, axial movement of the tool in the case is prevented when the handle of the shaft and its fitting are respectively received in the first and second sockets. Moreover, the tool may only be removed from the case by first disengaging the work engaging fitting from the second socket and then disengaging the handle from the first socket.

A strap is hinged to the case body and, when closed, prevents disengagement of the fitting from the second socket. However, this strap is relatively narrow and exposes a large portion of the tool for display purposes.

Accordingly, the case may be used to display tools for sale. However, the case may be mounted in a shop, garage, or the like to hold and protect the tool after purchase but when not in use.

Accordingly, it is an object of the present invention to provide a tool case which may be used to display, carry and store a tool while protecting the tool's components to prevent damage. Other objects, aspects, and advantages of the present invention will be pointed out in, or will be understood from, the following detailed description provided below in conjunction with the accompanying drawings.

DETAILED DESCRIPTION OF THE PREFERRED EMBODIMENT

FIGS. 1 through 4 illustrate the tool case constructed in accordance with the preferred embodiment of the present invention in detail. This tool case, generally indicated at 10, is adapted to store, carry, and display a tool in the form of a beam torque wrench, generally indicated at 12, which may be of the type illustrated and described in U.S. Pat. No. 3,726,135 (Vuceta).

Figure 2:
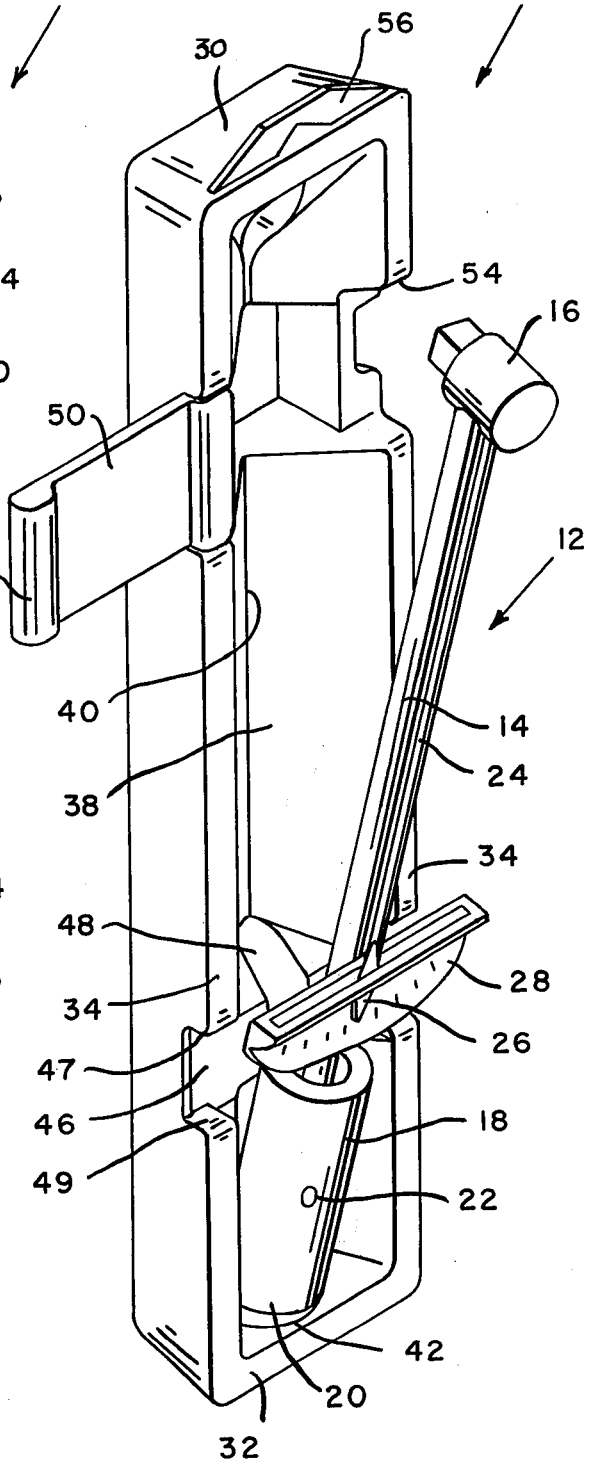
FIG. 2 is a similar perspective view of this case shown with the torque wrench being removed therefrom after its strap has been opened.
Figure 3:
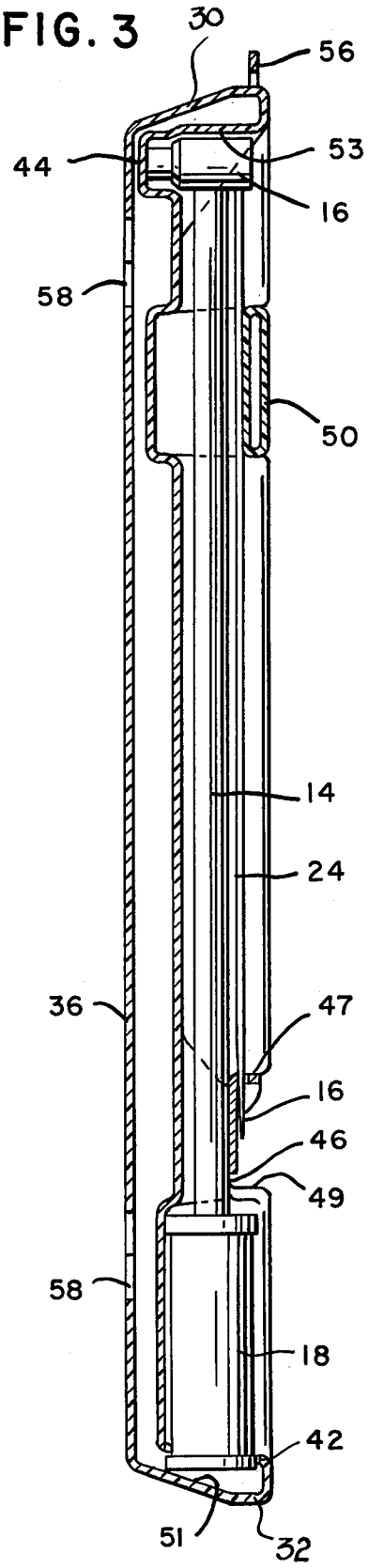
FIG. 3 is a vertical cross-section view of the tool case taken through plane 3—3 in FIG. 4 looking toward the left.

As can be seen in FIGS. 2 and 3, the torque wrench includes a main shaft 14 and a work engaging fitting 16 attached at one end of the shaft and extending perpendicularly thereto. The fitting 16 is adapted to accept various tool attachments such as sockets for engaging bolts. The wrench further includes a handle 18 attached to the opposite free end 20 of shaft 14 by means of a pivot pin 22 that is generally parallel to fitting 16. By attaching the handle to the shaft through the pin 22, the length of the moment arm from the pin to the fitting 16 is maintained at a constant value. Accordingly, a more accurate indication of the torque applied by the wrench is yielded.

The wrench further comprises a torque indicating beam 24 which is cantilevered from the fitting 16 and extends in parallel relation to the shaft 14 when at rest. At its free end, beam 24 is formed with a pointer 26 positioned to register against a torque indicating gauge 28. The gauge 28 is also fixed to shaft 14 but extends perpendicularly thereto as well as to the fitting 16 and pin 22. When the wrench is used to apply torque to a bolt or the like, the shaft 14 deflects relative to the fitting 16 by an amount directly proportional to the amount of torque applied. However, the beam 24 remains straight. Accordingly, the beam pointer 26 shifts relative to gauge 28 to give an indication of the torque applied. The beam and gauge as well as the remaining components of the wrench are protected during storage, carrying and display by the case 10 of the invention.

As shown in detail in FIGS. 1 through 4, the tool case 10 is generally rectangular in shape having top, bottom and side walls 30, 32, and 34 respectively and an enclosed back 36. The top, bottom and side walls define an open front 38 which is formed with a tool shaft accepting recess 40 that extends longitudinally of the case. A first socket 42 is formed in bottom wall 32 and extends axially from the shaft accepting recess 40 to accept the base of handle 18 of the torque wrench 12. At the upper end of the recess 40, a second socket 44, which extends perpendicularly thereto, is formed. This second socket receives the work engaging fitting 16 of the torque wrench as can be seen in detail in FIG. 3.

A platform 46 is molded into the case intermediate top and bottom walls 30 and 32 and is formed with a central slot that coincides with the shaft accepting recess 40. The platform is also recessed from the side walls 34 to form two barriers 47 and 49 on each. As shown in the FIGURES, this platform is positioned to receive the gauge 28 when the torque wrench is placed in the case so that barriers 47 and 49 prevent axial movement of the gauge.

The respective sockets 42 and 44, the shaft accepting recess 40, and the platform 46 cradle and limit the movement of the torque wrench when received therein. Accordingly, when, as shown in FIG. 3, the handle 18 of the wrench is received in the first socket 44, axial movement of the wrench is prevented. Specifically, as can be seen in FIG. 3, when the tool is so received, the tool handle 18 abuts the interior 51 of the bottom body wall 32 and the extreme end of the fitting 16 abuts the top 53 of second socket 44. However, axial movement may be equally well prevented by employing a simple abutment at the extreme end of the wrench fitting in place of the second socket 44. Moreover, when the gauge 28 is received on the platform 46, as well as when the fitting is received in the second socket, rotation of the wrench is prevented. Moreover, when the wrench is received in the case, all of its components are protected since they lie below the edges of the top, bottom and side walls.

Figure 1:
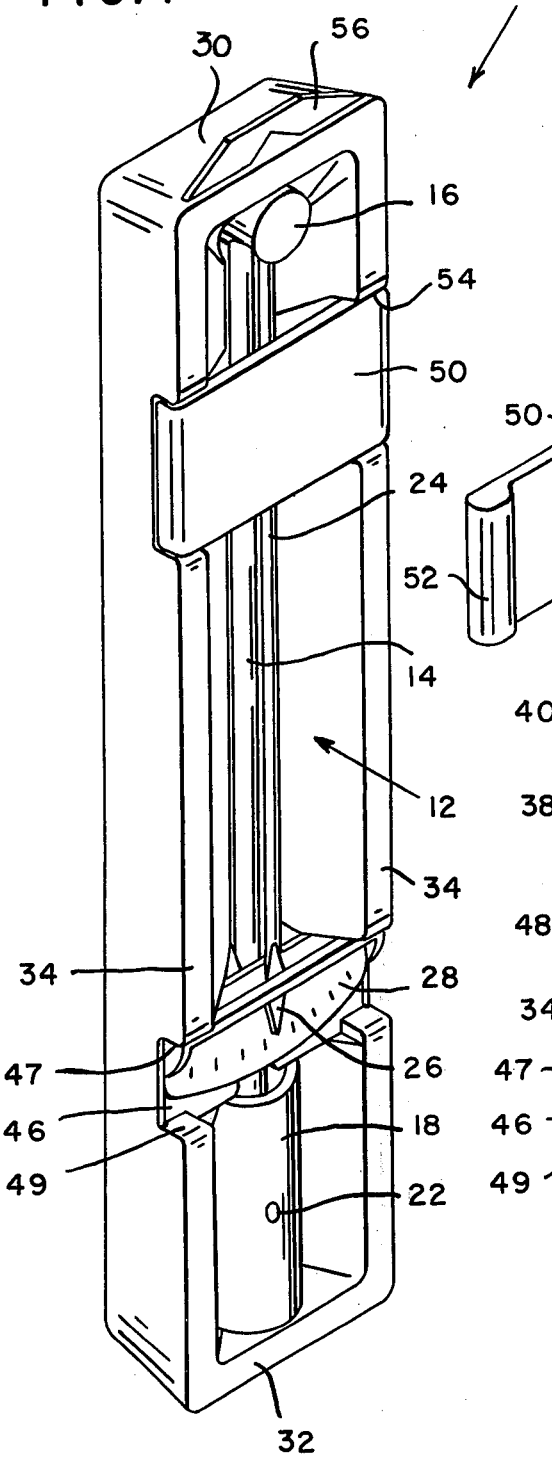
FIG. 1 is a perspective view of the tool case of the present invention in which a tool in the form of a beam torque wrench is stored.

As shown in FIGS. 1 and 2, the wrench can only be removed from the case by first disengaging the fitting 16 from the second socket 44 and pivoting the fitting end of the wrench out of the case. Conversely, the wrench must be replaced in the case by first engaging the handle 18 of the wrench in the first socket 42 and then swinging the upper end of the wrench and particularly fitting 16 inwardly toward the case into the shaft accepting recess 40.

The wrench is held firmly in the case by a strap 50 which is hinged to one side wall 34 of the case 10. As shown in FIG. 1, the strap may be pivoted to a closed position where its free end 52 snap fits with a linear cut-out portion 54 in the opposite side wall. When closed, the strap prevents the fitting end of the wrench from pivoting outwardly of the case and, hence, prevents disengagement of the entire wrench from the case. However, when in its open position as shown in FIG. 2, the strap permits the wrench to be removed from the case as described above.

An upper hanger 56, formed with upper wall 30, can be used to suspend the case and a wrench mounted in it from a peg for display purposes. In this fashion, many cases holding wrenches may be mounted one on top the other for sale.

Figure 4:
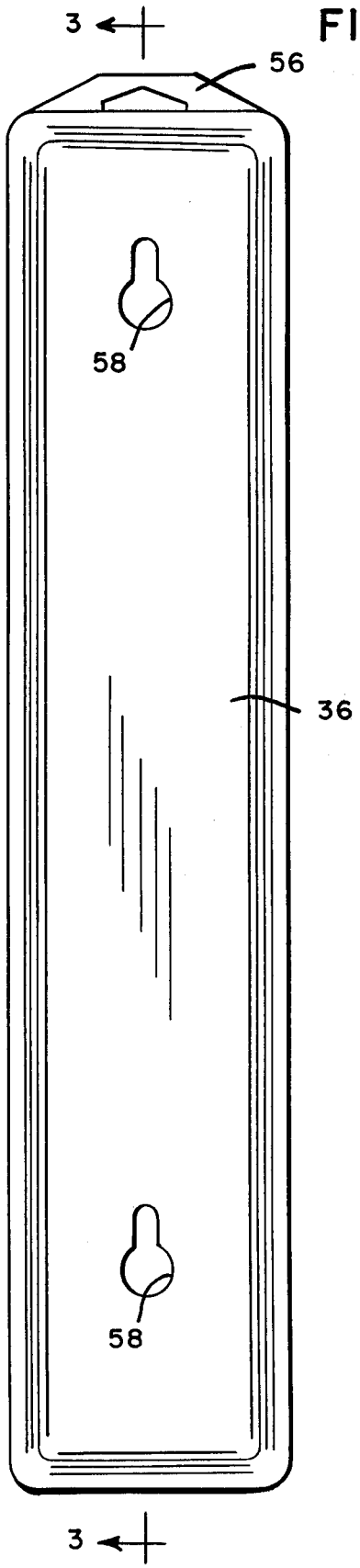
FIG. 4 is a rear elevational view of this tool case.

As shown in FIG. 4, the back 36 of the case is formed with two key-like holes 58 which may be used with conventional screws to mount the case, for example, on a shop or garage wall or bench. The holes are situated so that the case is mounted in a generally vertical attitude with the second socket positioned above the first. Accordingly, the case may be used to hold and store the wrench when not in use after it has been purchased.

Figure 5:
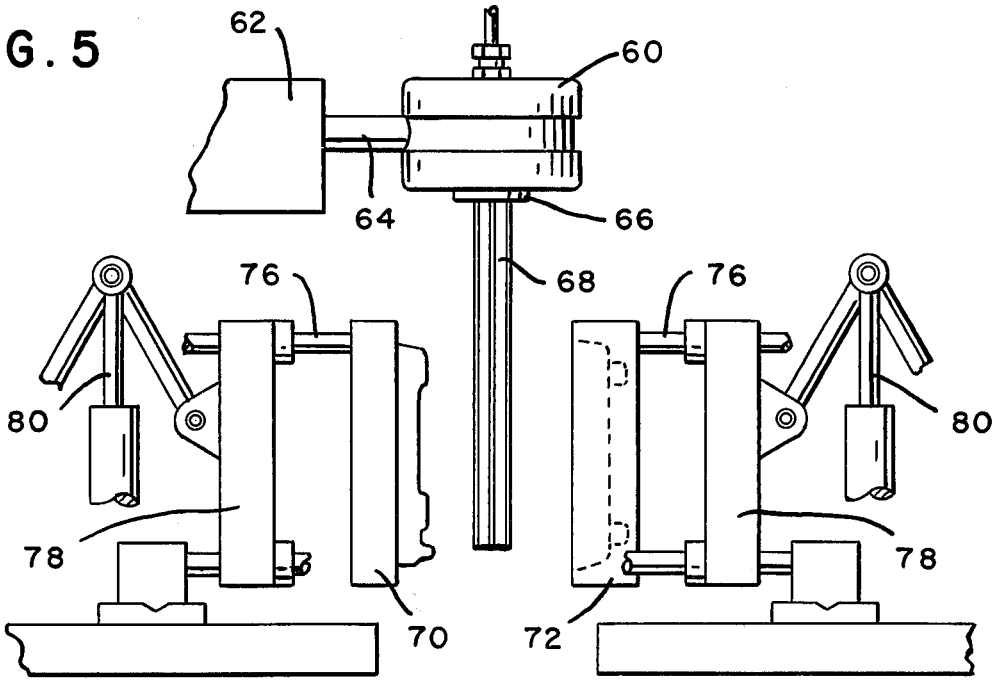
FIG. 5 is a diagrammatic side elevational view of a blow molding apparatus for manufacturing the tool case illustrated in FIGS. 1 through 4.
Figure 6:
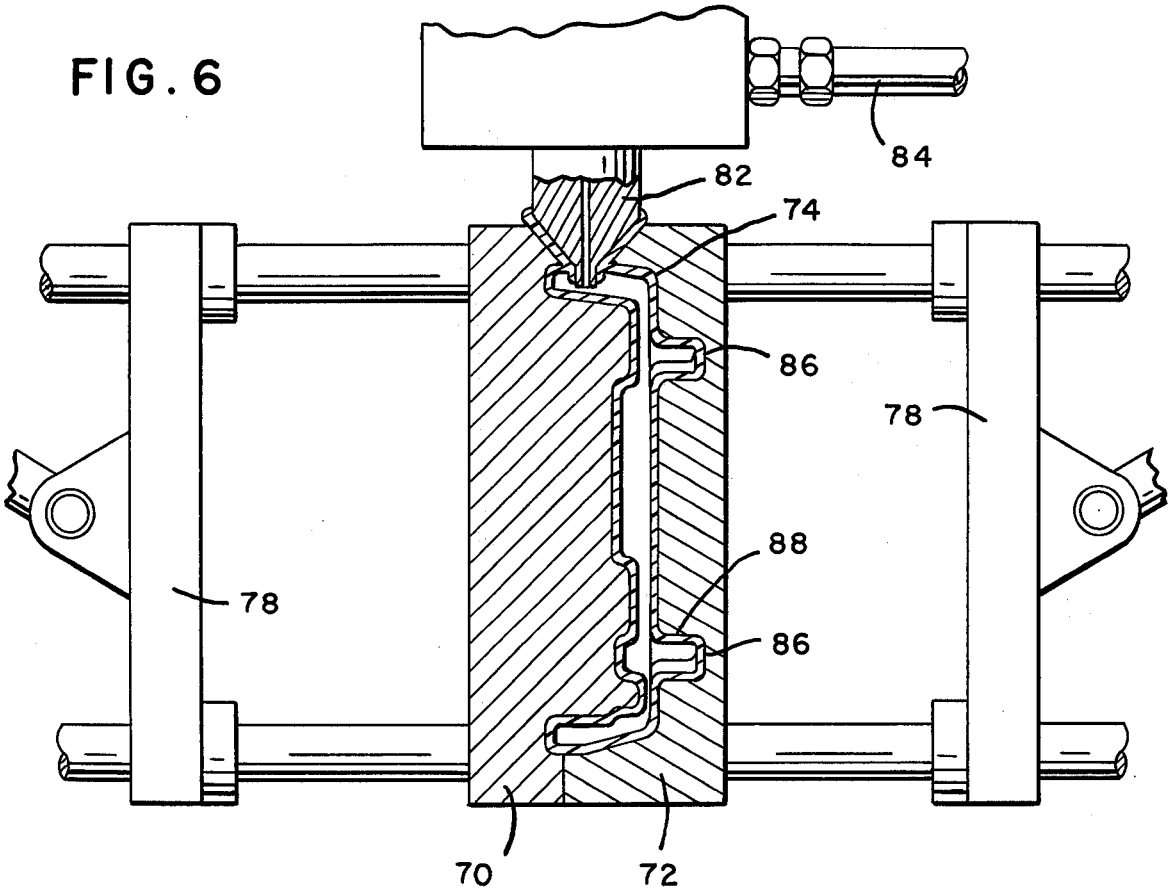
FIG. 6 is an enlarged vertical cross-sectional view of this blow molding apparatus illustrating in detail the manner in which certain holes in the case are formed.

The torque wrench case of the present invention is preferably blow molded from a thermoplastic resin so that it is light in weight. Suitable blow molding apparatus for making the case is shown in FIGS. 5 and 6 in diagrammatic form. This apparatus comprises a conventional thermoplastic extrusion head 60 which is connected to a hopper 62 by means of a heated feed tube 64. A thermoplastic resin in bead or chip form is melted in the hopper 62, fed by means of an auger (not shown) through the tube 64, to the extrusion head 60 from which it is extruded through a suitable die 66 as a depending tubular parison 68.

The extrusion head 60 is positioned so that the parison depends between mating die members 70 and 72 which when mated together define a mold cavity 74 (FIG. 6) configured to the external shape of the case. The die members are mounted for reciprocal movement toward and away from each other on rails 76 and are moved by means of backing plates 78 actuated through hydraulic toggles 80. As shown in FIG. 6, after the parison has been extruded between the die members and after the die members have closed about it, an injection needle 82 is inserted into one end of the parison. A fluid such as air is injected under pressure from a source (not shown) through a tube 84 and needle 82 to force the parison out into conformity with the inner walls of the die members.

The die member 72 is formed with two cavities 86 which permit the parison, when blown, to form bulbous flashings 88 in the back of the case. The flashings are sheared off flush with the case back 36 to form the mounting holes 58.

The first socket 42 may be drilled into the bottom wall of the case 32.

It can be readily appreciated from the description given above that the case of the present invention provides a convenient means for displaying, carrying and storing a wrench such as a torque wrench described above. The wrench is securely held in the case during any of these operations and its delicate components are protected by being recessed therein.

Accordingly, although a specific embodiment of the present invention has been described above in detail, it is to be understood that this is for pusposes of illustration. Modifications may be made to the described structure by those skilled in the art in order to adapt this tool case to particular applications for holding, carrying and storing various tools.

What is claimed is:

1. A case for a tool which includes an elongated shaft, having a free end and an extreme end axially opposed to the free end, said case comprising:

a body formed with 1. an elongated tool shaft accepting recess;
2. socket means extending axially from said recess formed to receive at least a portion of the free end of the shaft;
3. abutment means extending generally perpendicularly from said recess formed to abut the extreme end of the shaft; and
4. means for preventing disengagement of a tool shaft extreme end from said recess to thereby prevent removal of the tool from said case, said preventing means comprising a strap hinged to said body for pivoted movement between positions closed over said recess and open away from said recess;

whereby the free end of a tool shaft may be received in said socket means and the extreme end of a tool shaft may abut said abutment means to prevent axial movement of a tool stored in the case, and whereby a tool may only be removed from said case by first disengaging the extreme tool shaft end from abutment with said abutment means and then disengaging the free end of the tool shaft from said socket means.

2. The case for a tool as claimed in claim 1 wherein the tool further has gauge means attached to its shaft to be non-parallel to both the shaft and the fitting, and wherein said body is further formed with:

a platform portion, extending at an angle to said recess equal to the angle between the tool shaft and gauge means formed to receive the gauge means.

3. The case for a tool as claimed in claim 2 wherein said case body is further formed with barrier means, adjacent said platform portion, for preventing axial movement of a tool received in said body.

4. The case for a tool as claimed in claim 1 wherein said case body is further formed with means for mounting said body with said recess extending generally vertically and said abutment means disposed above said socket means.

5. The case for a tool as claimed in claim 4 wherein said mounting means comprises:

at least one mounting hole formed in said body on the side thereof opposite said recess.

6. The case for a tool as claimed in claim 1 wherein said body further comprises:

wall means bounding at least a portion of said recess, said socket means and said abutment means and upstanding therefrom to protect a tool stored in said case.

7. The case for a tool as claimed in claim 1 wherein said tool further includes a fitting attached to and extending generally perpendicularly from the shaft at a location spaced from the free shaft end and wherein said abutment means comprises:

a second socket formed to receive the tool fitting.

* * * * *